US007747195B2

(12) United States Patent
Yoshino et al.

(10) Patent No.: US 7,747,195 B2
(45) Date of Patent: Jun. 29, 2010

(54) FIXING DEVICE WITH TEMPERATURE COMPENSATING UNIFORMING SECTION AND IMAGE FORMING APPARATUS

(75) Inventors: Daisuke Yoshino, Kanagawa (JP); Hideaki Ohhara, Kanagawa (JP); Kazuyoshi Itoh, Kanagawa (JP); Yasutaka Naito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 907 days.

(21) Appl. No.: 11/581,482

(22) Filed: Oct. 17, 2006

(65) Prior Publication Data

US 2007/0166084 A1 Jul. 19, 2007

(30) Foreign Application Priority Data

Jan. 17, 2006 (JP) ..... P2006-008859

(51) Int. Cl.
*G03G 15/20* (2006.01)

(52) U.S. Cl. ..... 399/122; 399/45; 399/69; 399/328; 399/339; 399/334; 219/216

(58) Field of Classification Search ..... 399/45, 399/69, 328, 329, 334, 122; 219/216
See application file for complete search history.

(56) References Cited

U.S. PATENT DOCUMENTS

| | | | | |
|---|---|---|---|---|
| 5,212,528 | A * | 5/1993 | Matsuda | 399/33 |
| 5,897,249 | A * | 4/1999 | Aslam et al. | 399/329 |
| 6,047,158 | A | 4/2000 | Morigami et al. | |
| 6,650,863 | B2 * | 11/2003 | Fuma | 399/329 |
| 7,088,935 | B2 | 8/2006 | Kagawa et al. | 399/68 |
| 7,266,319 | B2 | 9/2007 | Kagawa et al. | 399/69 |
| 7,388,595 | B2 | 6/2008 | Yasuda et al. | |
| 2003/0063916 | A1 * | 4/2003 | Katayanagi et al. | 399/44 |
| 2005/0078990 | A1 * | 4/2005 | Shiraishi | 399/329 |
| 2006/0171749 | A1 * | 8/2006 | Tomita et al. | 399/329 |

FOREIGN PATENT DOCUMENTS

| | | |
|---|---|---|
| CN | 1540456 | 10/2004 |
| JP | 63-313182 | 12/1988 |
| JP | 2-157878 | 6/1990 |
| JP | 3-59584 | 3/1991 |
| JP | 08152804 A * | 6/1996 |
| JP | 2000-162907 | 6/2000 |
| JP | 2001-265142 | 9/2001 |
| JP | 2003-84597 | 3/2003 |
| WO | WO 2005/038532 A1 | 4/2005 |

* cited by examiner

*Primary Examiner*—David M Gray
*Assistant Examiner*—G. M. Hyder
(74) *Attorney, Agent, or Firm*—Morgan, Lewis & Bockius LLP

(57) ABSTRACT

A fixing device for fixing a toner image onto a recording medium, includes: a belt member rotatably provided; a heating section that heats the belt member; a pressurization member, placed so as to be pressed against the belt member, that forms a nip portion to allow the recording medium to pass through between the pressurization member and the belt member; and an uniforming section that uniforms a temperature distribution in a longitudinal direction of the pressurization member.

9 Claims, 11 Drawing Sheets

FIXING DEVICE WITH TEMPERATURE COMPENSATING UNIFORMING SECTION AND IMAGE FORMING APPARATUS

BACKGROUND (i) Technical Field

This invention relates to a fixing device and an image formation apparatus such as a copier and a printer using the fixing device.

(ii) Related Art

In an image formation apparatus of a copier, etc., a predetermined image formation process is adopted. For example, in the image formation process of an electrophotographic process, an electrostatic recording process, a magnetic recording process, etc., an unfixed image of objective image information (for example, toner image) is recorded and supported on a recording medium according to a transfer method or a direct method. As the recording medium, a transfer sheet, an electrofax sheet, electrostatic recording paper, an OHP sheet, print paper, and format paper can be named, for example. The unfixed image is heated and fixed on a recording medium side as a permanent fixed image in a fixing device.

As the fixing device, (a) a device adopting a heat roll method is widely used, but recently (b) a device adopting a film heating method has become commercially practical from the viewpoints of quick start and energy saving. (c) a device adopting an electromagnetic induction heating method has also become commercially practical.

In every fixing device described above, the recording medium takes heat at the fixing time, whereby the temperature of the portion through which the recording medium passes lowers. As the temperature lowers, it is feared that temperature unevenness at the fixing time may occur and a fixing failure of unevenness of image gloss, etc., may occur.

SUMMARY

A fixing device for fixing a toner image onto a recording medium includes: a belt member rotatably provided; a heating section that heats the belt member; a pressurization member, placed so as to be pressed against the belt member, that forms a nip portion to allow the recording medium to pass through between the pressurization member and the belt member; and an uniforming section that uniforms a temperature distribution in a longitudinal direction of the pressurization member.

BRIEF DESCRIPTION OF THE DRAWINGS

Exemplary embodiments of the present invention will be described in detail based on the following figure, wherein.

DETAILED DESCRIPTION

To begin with, a first exemplary embodiment of the invention will be discussed in detail with reference to the accompanying drawings.

Figure 1:
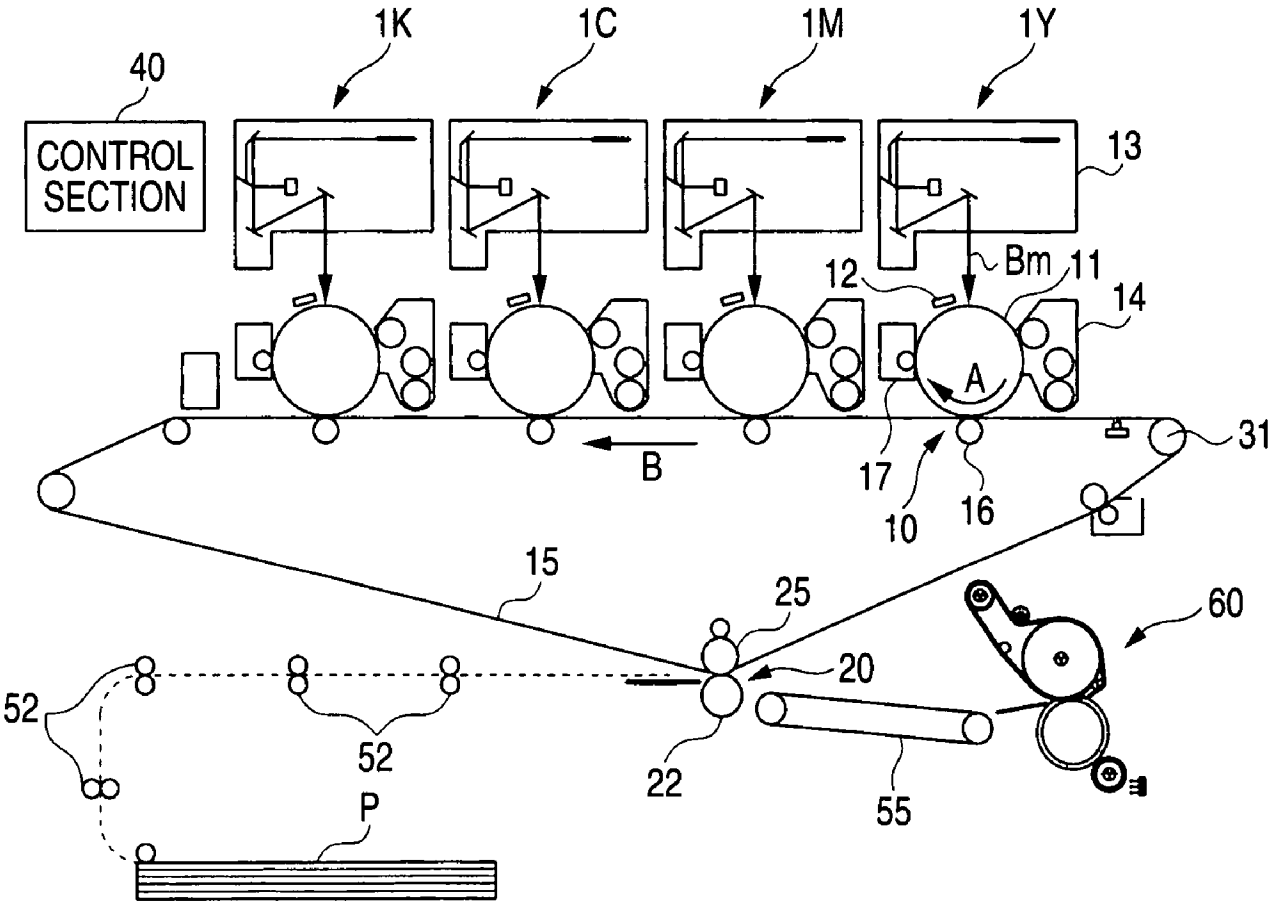
FIG. 1 is a schematic configuration drawing to show an image formation apparatus of a first exemplary embodiment of the invention.

FIG. 1 is a schematic configuration drawing to show an image formation apparatus of the first exemplary embodiment of the invention. The image formation apparatus shown in FIG. 1 is an image formation apparatus adopting an intermediate transfer system generally called tandem type. The image formation apparatus includes plural image formation units 1Y, 1M, 1C, and 1K for forming toner images of color components according to electrophotography. It also includes first transfer sections 10 for transferring the color component toner images formed by the image formation units 1Y, 1M, 1C, and 1K to an intermediate transfer belt 15 in order (first transfer). The image formation apparatus further includes a second transfer section 20 for transferring the superposed toner images transferred onto the intermediate transfer belt 15 to paper P of a recording medium (record paper) in batch (second transfer). It also includes a fixing device 60 for fixing the second transferred image onto paper. The image formation apparatus further includes a control section 40 for controlling the operation of the components. The control section 40 also controls turning on/off a heater 631 as a heating section and a cooling fan 65 as a part of a cooling section shown in FIG. 3, etc. The control section 40 also functions as a switching section for switching between heating of a pressurization roll 62 by the heater 631 and cooling of the pressurization roll 62 by the cooling fan 65.

In the exemplary embodiment, the following electrophotographic devices are disposed in each of the image formation units 1Y, 1M, 1C, and 1K: Provided in the surroundings of a photoconductor drum 11 for rotating in the arrow A direction is a charger 12 for charging the photoconductor drum 11. A laser exposure device 13 for writing an electrostatic latent image onto the photoconductor drum 11 (in the figure, an exposure beam is indicated by symbol Bm) is provided on the photoconductor drum 11. Further, a developing device 14 storing color component toner for visualizing the electrostatic latent image on the photoconductor drum 11 in the toner is provided. A first transfer roll 16 for transferring the color component toner image formed on the photoconductor drum 11 to the intermediate transfer belt 15 in the first transfer section 10 is provided. A drum cleaner 17 for removing remaining toner on the photoconductor drum 11 is provided.

The intermediate transfer belt 15 is circulated (turned) at predetermined speed in the arrow B direction shown in FIG. 1 by various rolls of a drive roll 31, etc., driven by a motor (not shown) excellent in a constant speed property.

The first transfer section 10 contains the first transfer roll 16 placed facing the photoconductor drum 11 with the intermediate transfer belt 15 between. The toner images on the photoconductor drums 11 are electrostatically attracted onto the intermediate transfer belt 15 in order and the superposed toner images are formed on the intermediate transfer belt 15.

The second transfer section 20 is made up of a second transfer roll 22 placed on the toner image support side of the intermediate transfer belt 15 and a backup roll 25. The second transfer roll 22 is pressed against the backup roll 25 with the intermediate transfer belt 15 between. Further, the second transfer roll 22 is grounded and a second transfer bias is formed between the second transfer roll 22 and the backup roll 25 for second transferring the toner images onto paper transported to the second transfer section 20.

Next, the basic image formation process of the image formation apparatus according to the exemplary embodiment will be discussed. In the image formation apparatus in the exemplary embodiment, image data is output from an image reader (IIT), etc., not shown. The image data is subjected to predetermined image processing by an image processing apparatus (IPS) not shown and is converted into color material gradation data of four colors of Y, M, C, and K and the color material gradation data is output to each laser exposure device 13.

Each laser exposure device 13 applies an exposure beam Bm emitted from a semiconductor laser, for example, to the corresponding photoconductor drum 11 of the image formation unit 1Y, 1M, 1C, 1K. The surface of each photoconductor drum 11 is charged by the charger 12 and then is scanned and exposed to light by the laser exposure device 13, forming an electrostatic latent image. The formed electrostatic latent images on the photoconductor drums 11 are developed by the developers 14 of the image formation units 1Y, 1M, 1C, and 1K to Y, M, C, and K color toner images. The toner image formed on each photoconductor drum 11 is transferred onto the intermediate transfer belt 15 in the first transfer section 10 where the photoconductor drum 11 and the intermediate transfer belt 15 abut each other.

After the toner images are first transferred on to the surface of the intermediate transfer belt 15 in order, the intermediate transfer belt 15 moves for transporting the toner images to the second transfer section 20. In the second transfer section 20, the second transfer roll 22 is pressed against the backup roll 25 via the intermediate transfer belt 15. At this time, paper transported by transport rolls 52, etc., at a proper timing is put between the intermediate transfer belt 15 and the second transfer roll 22. Unfixed toner images supported on the intermediate transfer belt 15 are electrostatically transferred onto the paper in batch in the second transfer section 20. Then, the paper onto which the toner images are electrostatically transferred is transported in a state in which it is removed from the intermediate transfer belt 15 by the second transfer roll 22, and is transported to a transport belt 55 provided downstream from the second transfer roll 22 in the paper transport direction. The transport belt 55 is made up of two support rolls and a belt placed on the support rolls for stably transporting paper to the fixing device 60 at the optimum transport speed.

Next, the fixing device 60 to which the exemplary embodiment is applied will be discussed.

Figure 2:
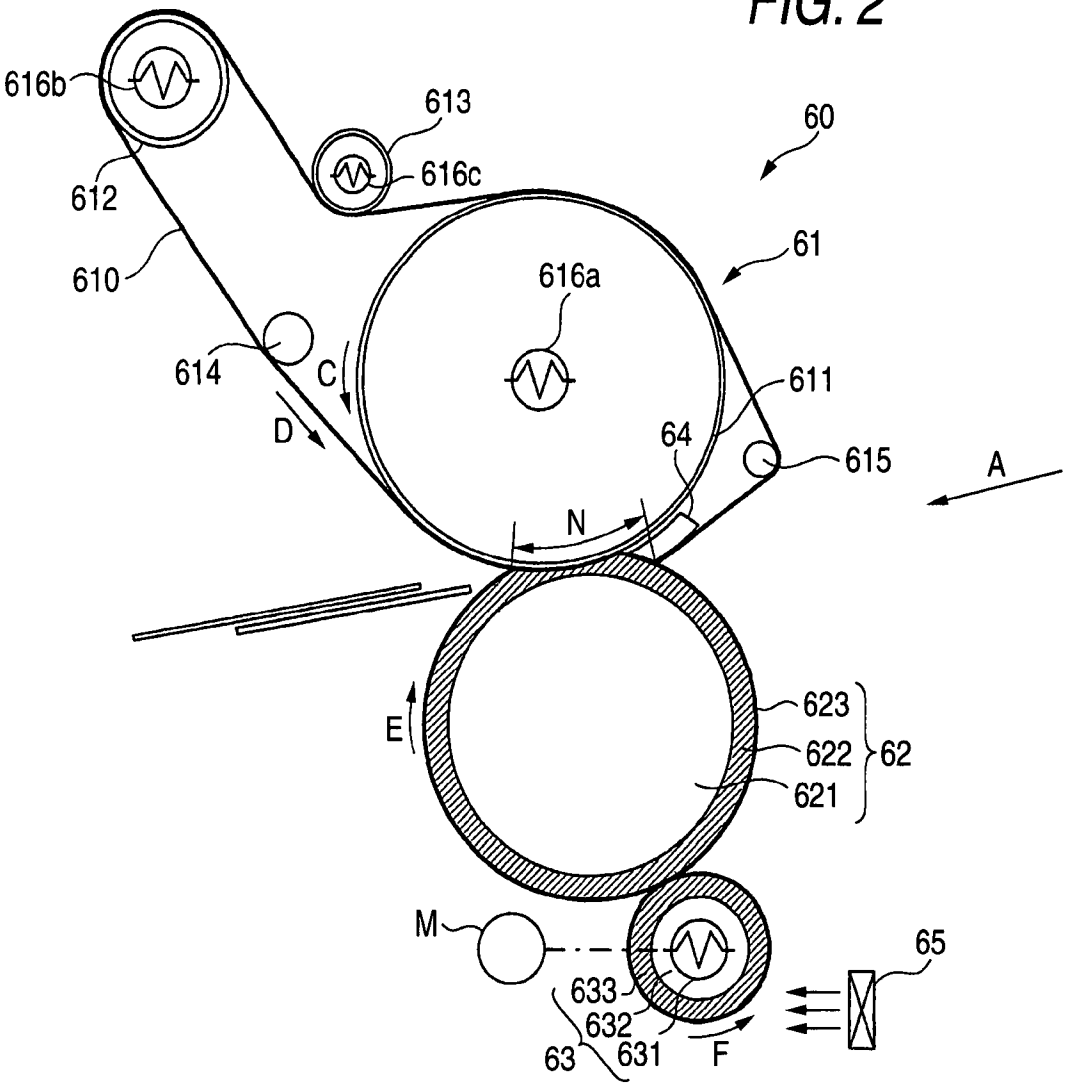
FIG. 2 is a sectional view to show the schematic configuration of a fixing device of the exemplary embodiment of the invention.

FIG. 2 is a sectional view to show the schematic configuration of the fixing device 60 of the exemplary embodiment. The fixing device 60 includes a fixing belt module 61 as the main part. The fixing device 60 includes a pressurization roll 62 as an example of a pressurization member pressed against the fixing belt module 61. The fixing device 60 further includes as the main part, a contact member 63 as an example of an uniforming section pressed against the pressurization roll 62 for coming in contact with at least a part of the pressurization roll 62 and a cooling fan 65 as a cooling section of an example of an uniforming section for cooling the surface of the contact member 63. The fixing device 60 also includes a drive source M such as a motor as an example of a move section for bringing the contact member 63 provided in contact with the pressurization roll 62 away from the pressurization roll 62.

The fixing belt module 61 includes a fixing belt 610 as an example of a belt member, a fixing roll 611 formed like a cylinder for rotating with the fixing belt 610 placed thereon, and a tension roll 612 for stretching the fixing belt 610 from the inside. The fixing belt module 61 also includes a tension roll 613 for stretching the fixing belt 610 from the outside and an attitude correction roll 614 for correcting the attitude of the fixing belt 610 between the fixing roll 611 and the tension roll 612. The fixing belt module 61 further includes a removal pad 64 as an example of a removal member placed in a downstream area in a nip portion N of an area where the fixing belt module 61 and the pressurization roll 62 press each other and in the proximity of the fixing roll 611. The fixing belt module 61 also includes a tension roll 615 for stretching the fixing belt 610 downstream from the nip portion N.

The fixing belt 610 is a flexible endless belt. It is made up of a base layer made of polyimide, etc., and having a thickness of about 80 μm, an elastic layer made of silicone rubber, etc., having a thickness of about 50 μm deposited on the surface of the base layer (outer peripheral surface), and a mold release layer made of PFA, etc., having a thickness of about 30 μm deposited on the elastic layer. The fixing belt 610 moves (turns) in the arrow D direction with rotation of the fixing roll 611.

The fixing roll 611 is formed of a rigid body of metal, etc. The fixing roll 611 receives a drive force from a drive source (not shown) and rotates in the arrow C direction. The fixing roll 611 contains a heater 616*a* as a heating section. The tension roll 612 is a cylindrical roll and contains a heater 616*b* as a heating section. Therefore, the tension roll 612 has a function of heating the fixing belt 610 from the inner peripheral surface as well as the function of stretching the fixing belt 610. A spring member (not shown) for pressing the fixing belt 610 against the outside is disposed at both ends of the tension roll 612, giving tension to the whole fixing belt 610.

Further, the tension roll 613 is a cylindrical roll and contains a heater 616*c* as a heating section. Thus, the tension roll 613 has a function of heating the fixing belt 610 from the outer peripheral surface as well as the function of stretching the fixing belt 610. Therefore, in the exemplary embodiment, the fixing roll 611, the tension roll 612, and the tension roll 613 heat the fixing belt 610.

The pressurization roll 62 has a columnar roll 621 as a base body. From the base body side, an elastic layer 622 and a mold release layer 623 are deposited in order, forming a soft roll. The pressurization roll 62 is installed so that it is pressed against the fixing belt module 61. As the pressurization roll 62 is pressed against the fixing belt module 61, the elastic layer 622 and the mold release layer 623 become deformed like a recess in the direction of the columnar roll 621 and a part of the nip portion N is formed in the recess. As the fixing roll 611 of the fixing belt module 61 rotates in the arrow C direction, the pressurization roll 62 is driven by the fixing roll 611 and rotates in the arrow E direction.

As the pressurization roll 62 rotates in the arrow E direction, the contact member 63 is driven by rotation of the pressurization roll 62 and rotates in the arrow F direction. The contact member 63 is formed like a roll and contains a heater 631 as a heating section for heating the pressurization roll 62. The contact member 63 has a columnar roll 632 as a base body and includes an elastic layer 633 in the surroundings of the columnar roll 632. As the material of the elastic layer 633, silicone rubber can be named, for example. The contact member 63 can also adopt the same configuration as the pressurization roll 62. The cooling fan 65 is controlled appropriately by the control section. 40 (see FIG. 1), thereby cooling the surface of the contact member 63.

Paper with toner images transferred to the surface is put between the pressurization roll 62 and the fixing belt 610 and is introduced into the nip portion N. In the nip portion N, the paper is heated and pressed and the toner images are fixed onto the paper.

After the fixing belt 610 positioned in the nip portion N passes through the nip portion N, it reaches the removal pad 64 and rotates following the side of the removal pad 64. Accordingly, the traveling direction of the fixing belt 610 changes rapidly so as to bend in the direction of the tension roll 615 by the removal pad 64. Thus, when the paper exits the press part formed by the removal pad 64 and the pressurization roll 62, it is made impossible for the paper to follow the change in the traveling direction of the fixing belt 610. Consequently, the paper is removed from the fixing belt 610 because of "elasticity" of the paper. Thus, self stripping is stably executed for the paper in the exit of the nip portion N. The traveling direction of the paper detached from the fixing belt 610 is guided by a removal guide plate (not shown) disposed downstream from the nip portion N.

By the way, when paper fixing is executed, heat of the nip portion N is taken and the temperature lowers instead of giving heat to the paper in the nip portion N.

For example, when small-size paper is fixed, heat throughout the area in the nip portion N is not taken and the temperature lowers in the area through which small-size paper having a narrower width than the maximum paper passage width of the width of the maximum paper that can pass through the nip portion N is passed (which will be hereinafter referred to as "small-size paper passage portion"). On the other hand, in any other area than the area through which small-size paper having a narrower width than the maximum paper passage width is passed (which will be hereinafter referred to as "non-small-size paper passage portion"), temperature lowering caused by paper does not occur and temperature rise occurs because heat is given from the fixing belt 610. Consequently, the temperature difference between the small-size paper passage portion and the non-small-size paper passage portion becomes large and a temperature difference also occurs in the pressurization roll 62 forming a part of the nip portion N corresponding to the small-size paper passage portion and the non-small-size paper passage portion.

The pressurization roll 62 expands outward as the temperature rises; a difference occurs in thermal expansion amounts due to the temperature difference and the expansion amount in the non-small-size paper passage portion becomes larger than that in the small-size paper passage portion. Consequently, an outer diameter difference occurs between the small-size paper passage portion and the non-small-size paper passage portion, causing a difference to occur in surface speed. Consequently, a problem of occurrence of a twist in the pressurization roll 62 occurs.

If large-size paper is fixed just after small-size paper is fixed successively, a temperature difference occurs between the surfaces of the small-size paper passage portion and the non-small-size paper passage portion and thus an image defect of unevenness of image gloss or hot offset easily occurs because of the surface temperature difference; this is a problem.

Such problems are observed particularly in the pressurization roll 62 using the thick elastic layer 622. The fixing roll 611, which generally is made of metal only, has good thermal conductivity and the heat of the non-small-size paper passage portion flows into the small-size paper passage portion and thus the temperature unevenness in the axial direction (longitudinal direction) of the fixing roll 611 lessens as compared with that of the pressurization roll 62. The fixing belt 610 has a small heat capacity and is in contact with the tension roll 613, etc., also serving as a heat source in circulation and thus the temperature unevenness in the axial direction of the fixing roll 611 is hard to occur.

When the pressurization roll 62 is provided with the elastic layer 622, if a twist occurs because of the surface speed difference as described above and is large, there is a possibility that a failure such as a wrinkle of the mold release layer 623 of PFA layer, etc., or destruction of the elastic layer 622 may be caused to occur. Further, the elastic layer 622 has a large heat capacity and thus holds heat and if the ambient temperature lowers, the expansion amount difference tends to be not immediately eliminated. Thus, problems of twist of pressurization roll, image gloss unevenness, and hot offset easily occur and are hard to be solved. Then, in the exemplary embodiment, the contact member 63 and the cooling fan 65 as an uniforming section for uniforming the temperature distribution (decreasing unevenness of the temperature distribution) in the axial direction of the pressurization roll 62 are provided. In the exemplary embodiment, the contact member 63 for coming in contact with the pressurization roll 62 is used as an example of the uniforming section, but a member for cooling the pressurization roll 62 in a non-contact state with the pressurization roll 62 can also be used as the uniforming section. For example, a cooling fan, etc., can be named as such an uniforming section.

Further, the periphery of the pressurization roll 62 will be discussed in detail.

Figure 3:
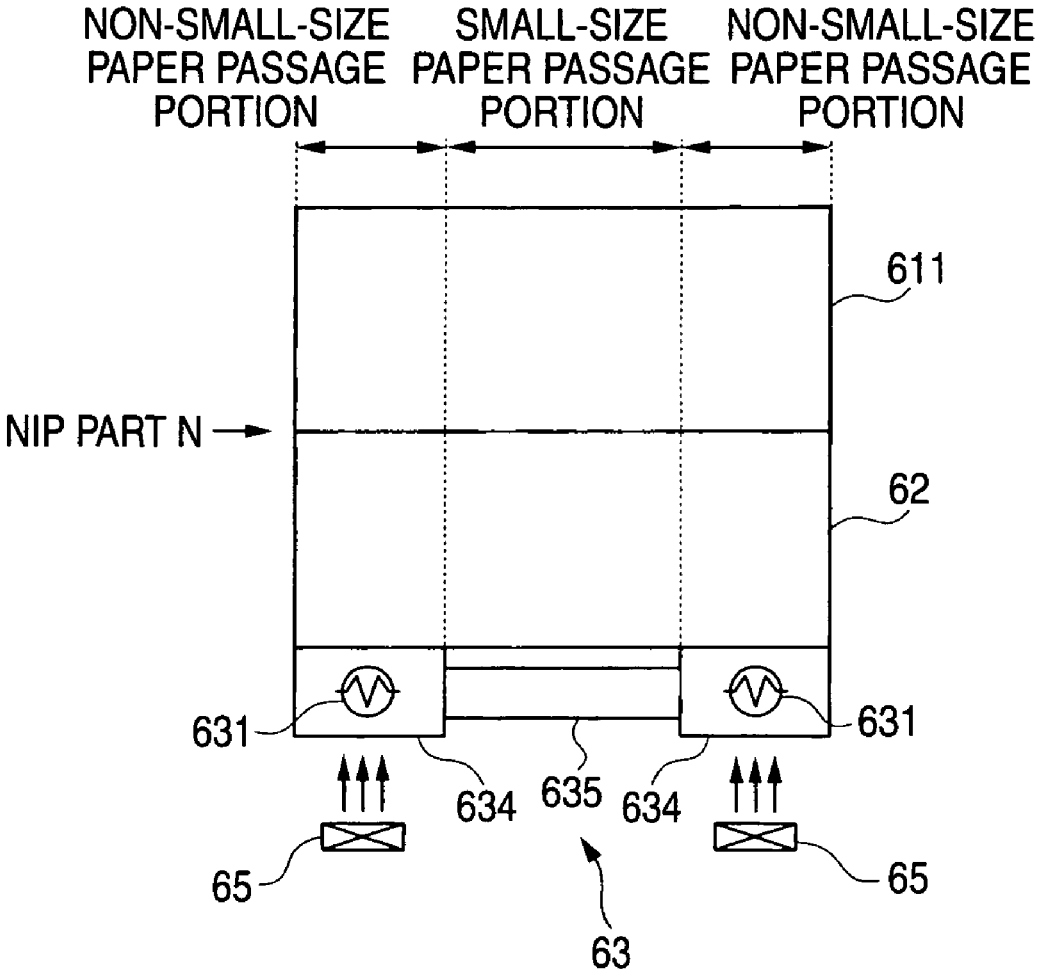
FIG. 3 is a schematic representation to show the form when the fixing device 60 is viewed from the right side.

FIG. 3 is a schematic representation to show the form when the fixing device 60 is viewed from the right side. For easy seeing, the fixing belt 610 and the tension roll 615 are not shown in the figure and the position of the cooling fan 65 is also shifted in the figure. In the exemplary embodiment, the form in center registration to allow paper to pass through with the rough center in the axial direction of the fixing roll 611, etc., as the reference is shown.

As shown in the figure, the pressurization roll 62 for pressing the fixing roll 611 is placed below the fixing roll 611, and the press part functions as the nip portion N. The toner images formed on paper are pressurized and heated in the nip portion N and are fixed onto the paper. The contact member 63 is formed like a roll and is positioned below the fixing roll 611 and is placed so as to press the pressurization roll 62 from below. The cooling fan 65 is placed at a predetermined distance from the contact member 63 and sends air to the contact member 63 for cooling the contact member 63.

In the exemplary embodiment shown in the figure, the center registration is adopted as described above and thus paper to be fixed passes through with the center in the axial direction of the fixing roll 611, etc., as the center. Thus, a small-size paper passage portion is formed in the rough center in the axial direction of the pressurization roll 62, etc., and a non-small-size paper passage portion is formed on both sides of the small-size paper passage portion.

The contact member 63 has a large diameter part 634 for coming in contact with the non-small-size paper passage portion and a small diameter part 635 formed smaller than the large diameter part 634 for coming in non-contact with the small-size paper passage portion. More specifically, the contact member 63 has the large diameter part 634 positioned at both ends in the axial direction of the contact member 63 for coming in contact with the non-small-size paper passage portion and the small diameter part 635 positioned roughly at the center of the contact member 63 for coming in non-contact with the small-size paper passage portion. Further, the contact member 63 contains a heater 631 for heating the pressurization roll 62.

The control section 40 (see FIG. 1) turns on/off the cooling fan 65 and the heater 631 and adjusts output. The control section 40 switches between the cooling state of the cooling fan 65 and the heating state of the heater 631 in accordance with the paper size output from a paper size detection section, etc., included in an image reader (IIT) not shown, for example. The control section 40 can also detect the type of used paper tray, for example, and switches between the cooling state of the cooling fan 65 and the heating state of the heater 631 according to the detection result. For example, to fix small-size paper, the control section 40 turns off the heater 631 and operates the cooling fan 65. To fix large-size paper, the control section 40 turns on the heater 631 without operating the cooling fan 65.

The functions of the contact member 63 and the heater 631 will be discussed in detail.

Figure 4A:
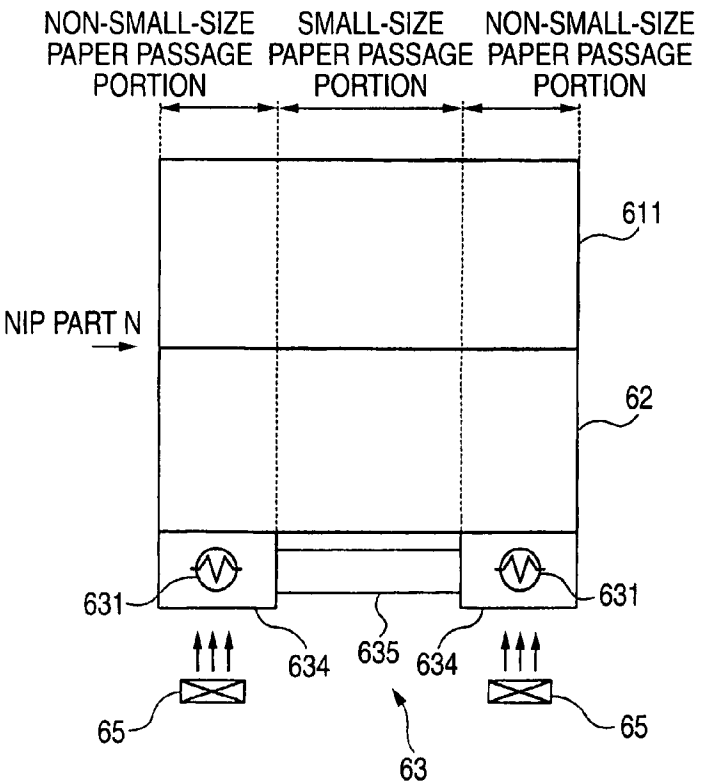
FIGS. 4A to 4C are schematic representations to show change in the temperature distribution on the surface of a pressurization roll with a contact member and a heater.
Figure 4B:
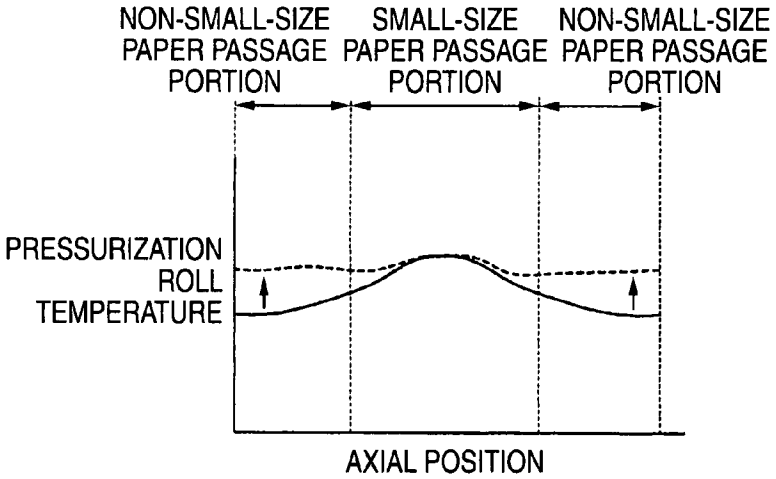
Figure 4C:
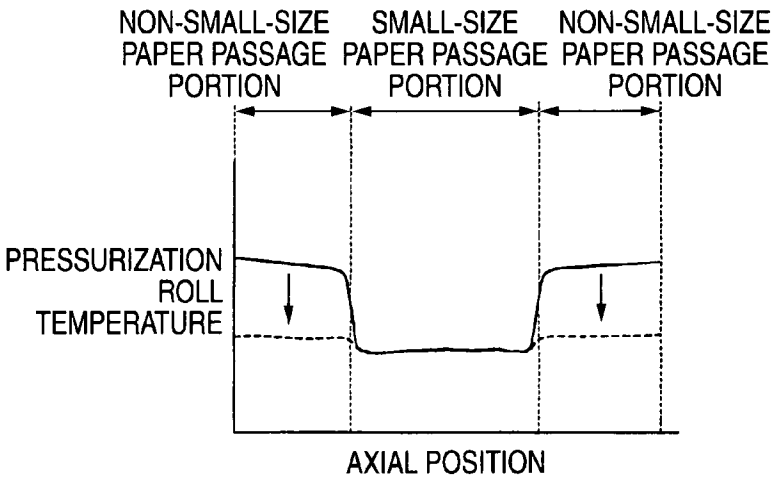

FIGA. 4A to 4C are schematic representations to show change in the temperature distribution on the surface of the pressurization roll 62 with the contact member 63 and the heater 631. FIG. 4B is a drawing to show the temperature change (rise) on the surface of the pressurization roll 62 with the heater 631, and FIG. 4C is a drawing to show the temperature change (lowering) on the surface of the pressurization roll 62 with the contact member 63. For convenience of the description, the drawing of FIG. 3 is again provided as FIG. 4A.

FIG. 4B is a drawing to show the case where the temperature on the surface of the pressurization roll 62 rises using the heater 631.

When paper close to the maximum paper passage width, namely, large-size paper is fixed, the surface temperature at each end becomes easily lower than that in the center because of heat radiation from the ends of the pressurization roll 62. The solid line in FIG. 4A indicates the situation and shows a state in which the temperature lowers in the non-small-size paper passage portion positioned both sides of the small-size paper passage portion rather than the small-size paper passage portion. Consequently, unevenness of image gloss caused by temperature unevenness in the axial direction of the pressurization roll 62 easily occurs. Then, in the exemplary embodiment, the heater 631 is heated for heating the non-small-size paper passage portion (both ends) of the pressurization roll 62 through the large diameter part 634. Consequently, the surface temperature of the pressurization roll 62 can be raised in the non-small-size paper passage portion as indicated by the dashed line.

On the other hand, FIG. 4C is a drawing to show the case where the temperature on the surface of the pressurization roll 62 lowers using the contact member 63.

As described above, when small-size paper is fixed, the temperature of the pressurization roll 62 lowers in the small-size paper passage portion and the non-small-size paper passage portion produces a higher temperature distribution than that of the pressurization roll 62 in the small-size paper passage portion (see the solid line). Then, in the exemplary embodiment, with the heater 631 turned off, the large diameter part 634 of the contact member 63 is brought into contact with the non-small-size paper passage portion of the pressurization roll 62 for transferring the heat in the non-small-size paper passage portion of the pressurization roll 62 to the contact member 63, thereby lowering the surface temperature of the pressurization roll 62. Consequently, the surface temperature of the pressurization roll 62 can be lowered in the non-small-size paper passage portion as indicated by the dashed line. If the cooling fan 65 is operated for sending air to the contact member 63 for lowering the temperature of the contact member 63, the temperature of the pressurization roll 62 can be lowered more efficiently.

The temperature of the pressurization roll 62 can be lowered only with the contact member 63 as described above and can also be lowered using the contact member 63 and the cooling fan 65. If the temperature difference between the pressurization roll 62 and the contact member 63 is sufficient and the temperature of the pressurization roll 62 is higher than that of the contact member 63, the pressurization roll 62 can be cooled only with the contact member 63. However, if the temperature difference is small, the cooling efficiency is lowered. In this case, if the cooling fan 65 is operated for lowering the temperature of the contact member 63, it is made possible to cool the pressurization roll 62 more efficiently. Of course, even if the temperature difference is sufficient, the pressurization roll 62 can be cooled with the contact member 63 and the cooling fan 65.

In the exemplary embodiment, the small diameter part 635 does not come in contact with the small-size paper passage portion (non-contact), but the outer diameter of the small diameter part 635 can be made close to the outer diameter of the large diameter part 634 so that the small diameter part 635 comes in contact with the pressurization roll 62 by a weak contact force in the small-size paper passage portion. The contact force for the small diameter part 635 to come in contact with the pressurization roll 62 in the small-size paper passage portion is smaller than the contact force for the large diameter part 634 to come in contact with the pressurization roll 62 in the non-small-size paper passage portion.

Further, the contact member 63 can also be placed so that it can be brought away from the pressurization roll 62. A move section for bringing the contact member 63 away from the pressurization roll 62 can be configured using the drive source M (see FIG. 2) and various already known mechanisms. The move section can also again bring the contact member 63 distant from the pressurization roll 62 into contact with the pressurization roll 62.

The problem of temperature unevenness occurring when small-size paper is fixed is noticeable when the setup temperature is high for fixing a cardboard, etc., and is hard to become a large problem when thin paper is fixed. Therefore, when thin paper is fixed, temperature control of the contact member 63 may be unnecessary. In such a case, the contact member 63 is brought away from the pressurization roll 62 and the operation of the cooling fan and the heater is stopped, whereby unnecessary power consumption can be prevented.

Next, modified examples of the contact member 63, etc., will be discussed.

Figure 5B:
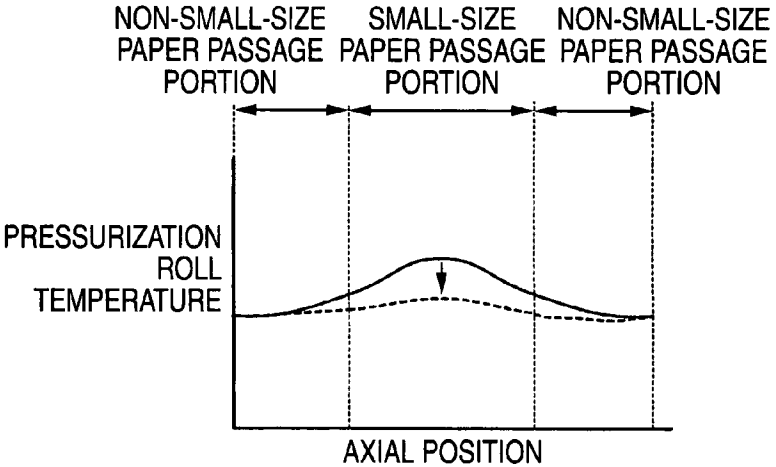
FIGS. 5A to 5C are schematic representations to show a modified example of the contact member, etc., and change in the temperature distribution of the pressurization roll with the contact member.
Figure 5C:
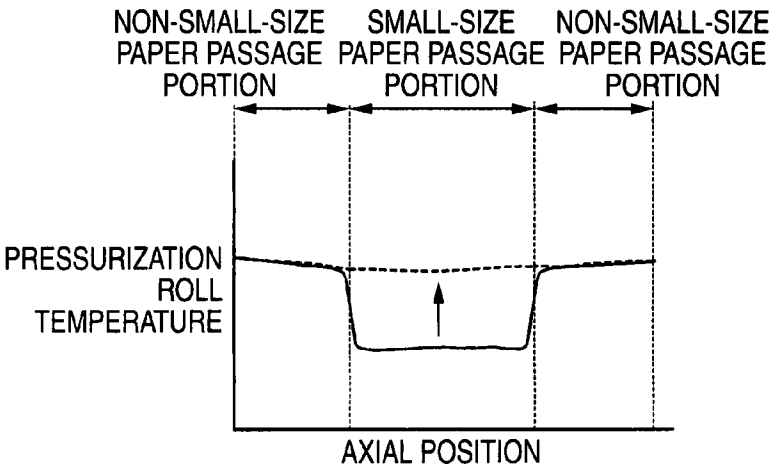
Figure 5A:
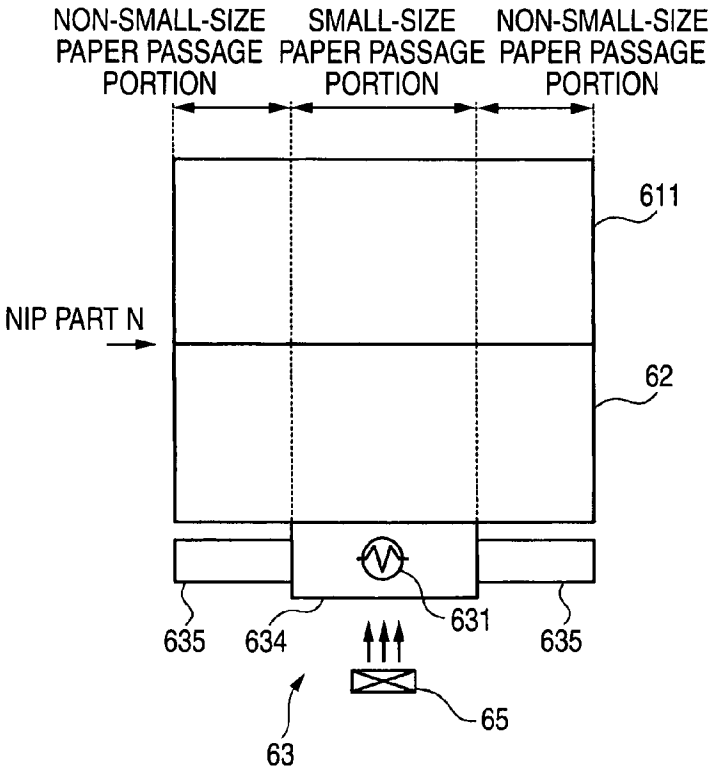

FIGS. 5A to 5C is a schematic representation to show a modified example of the contact member 63, etc., and change in the temperature distribution of the pressurization roll 62 with the contact member 63.

FIG. 5A is a schematic representation to show the form when the fixing device 60 is viewed from the right side as in FIG. 3. The contact member 63 shown in FIG. SA includes the large diameter part 634 for coming in contact with the pressurization roll 62 in the non-small-size paper passage portion and the small diameter part 635 in non-contact with the pressurization roll 62 at the position corresponding to the non-small-size paper passage portion on both sides of the large diameter part 634.

FIG. 5B is a drawing to describe the function of the contact member 63 when the surface temperature of the pressurization roll 62 in the non-small-size paper passage portion lowers and the surface temperature in the small-size paper passage portion is relatively high (see the solid line) as in FIG. 4B. The large diameter part 634 of the contact member 63 is in contact with the small-size paper passage portion and takes heat of the small-size paper passage portion. At this time, the heater 631 is off. Consequently, the temperature in the small-size paper passage portion can be lowered. Consequently, the temperature distribution in the longitudinal direction of the pressurization roll 62 can be uniformed as indicated by the dashed line in the figure. The temperature in the small-size paper passage portion can be lowered only with the contact member 63 or using the contact member 63 and the cooling fan 65 in combination as described above.

FIG. 5C is a drawing to describe the function of the contact member 63 when the surface temperature of the pressurization roll 62 in the non-small-size paper passage portion rises and the surface temperature in the small-size paper passage portion is low (see the solid line) as in FIG. 4C. The contact member 63 is in contact with the pressurization roll 62 in the large diameter part 634 with the heater 631 turned on. The heat of the heater 631 is transmitted to the pressurization roll 62 through the large diameter part 634, so that the surface temperature of the pressurization roll 62 rises in the contact part with the large diameter part 634. Consequently, the temperature distribution in the longitudinal direction of the pressurization roll 62 can be uniformed as indicated by the dashed line in the figure.

In the exemplary embodiment, the small diameter part 635 does not come in contact with the non-small-size paper passage portion (non-contact), but the outer diameter of the small diameter part 635 can be made close to the outer diameter of the large diameter part 634 so that the small diameter part 635 comes in contact with the pressurization roll 62 by a weak contact force in the non-small-size paper passage portion. The contact force for the small diameter part 635 to come in contact with the pressurization roll 62 in the non-small-size paper passage portion is smaller than the contact force for the large diameter part 634 to come in contact with the pressurization roll 62 in the small-size paper passage portion.

The surface temperature of the pressurization roll 62 can be partially raised or lowered using the contact member 63 and the cooling fan 65 as described above. Thus, unevenness of the surface temperature occurring in the pressurization roll 62 can be decreased for uniforming the temperature distribution as described above. Consequently, a fixing failure accompanying unevenness of the surface temperature of the pressurization roll 62, breakage of the pressurization roll 62, etc., can be suppressed.

The center registration has been described. Next, corner registration to allow paper to pass through to one side will be discussed.

Figure 6:
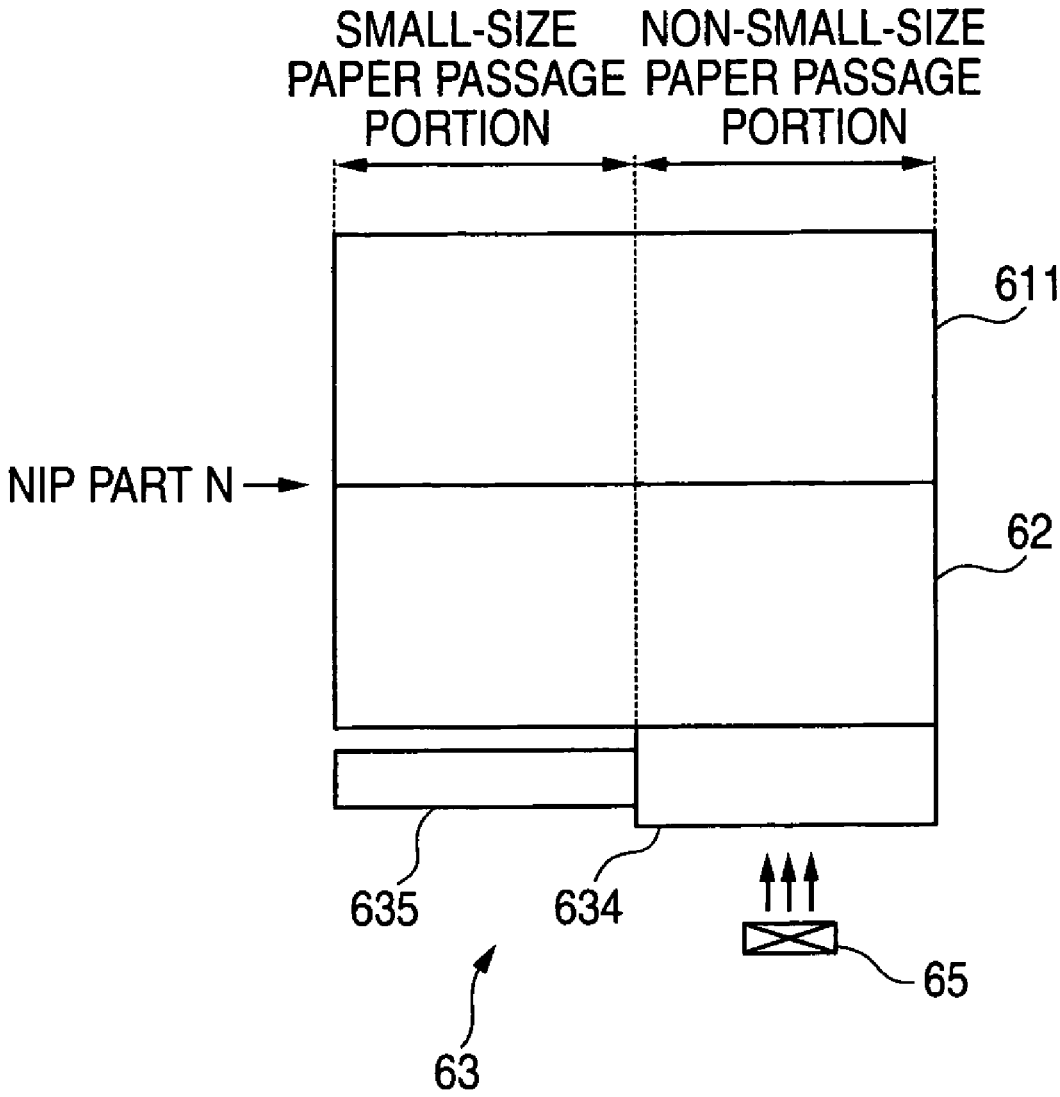
FIG. 6 is a schematic representation to show the placement mode, etc., of the contact member in corner registration.

FIG. 6 is a schematic representation to show the placement mode, etc., of the contact member 63 in the corner registration. The paper to be fixed is put to one side in the nip portion N formed by the fixing roll 611 and the pressurization roll 62. In the exemplary embodiment, paper is put to the left end and passes through the nip portion N. Thus, the small-size paper passage portion through which small-size paper passes is formed on one side (in the figure, the left) in the axial direction of the pressurization roll 62, etc., and the non-small-size paper passage portion of an area other than the small-size paper passage portion is formed on an opposite side (in the figure, the right).

In the temperature distribution of the pressurization roll 62, the temperature lowers in the small-size paper passage portion and the temperature in the non-small-size paper passage portion becomes higher than the temperature in the small-size paper passage portion. Then, in the exemplary embodiment, the large diameter part 634 is brought into contact with the pressurization roll 62 in the non-small-size paper passage portion and the temperature in the non-small-size paper passage portion is lowered using the large diameter part 634 or using the large diameter part 634 and the cooling fan 65. Consequently, unevenness of the temperature distribution of the pressurization roll 62 can be decreased for uniforming the temperature distribution.

The large diameter part 634 and the small diameter part 635 can also be placed as they are replaced with each other. That is, the large diameter part 634 including a heater (not shown) can be formed at the left of the contact member 63 so as to come in contact with the small-size paper passage portion and the small diameter part 635 can be formed at the right of the contact member 63 so as to come in non-contact with the non-small-size paper passage portion. In this case, the heater included in the contact member 63 can be used to raise the temperature in the small-size paper passage portion for uniforming the temperature distribution of the pressurization roll 62. The contact member 63 in the exemplary embodiment is implemented as the soft roll having the elastic layer 633, but a device having good thermal conductivity such as a heat pipe or an aluminum roll as used in a second exemplary embodiment described below can also be used.

Next, a second exemplary embodiment of the invention will be discussed.

Figure 7:
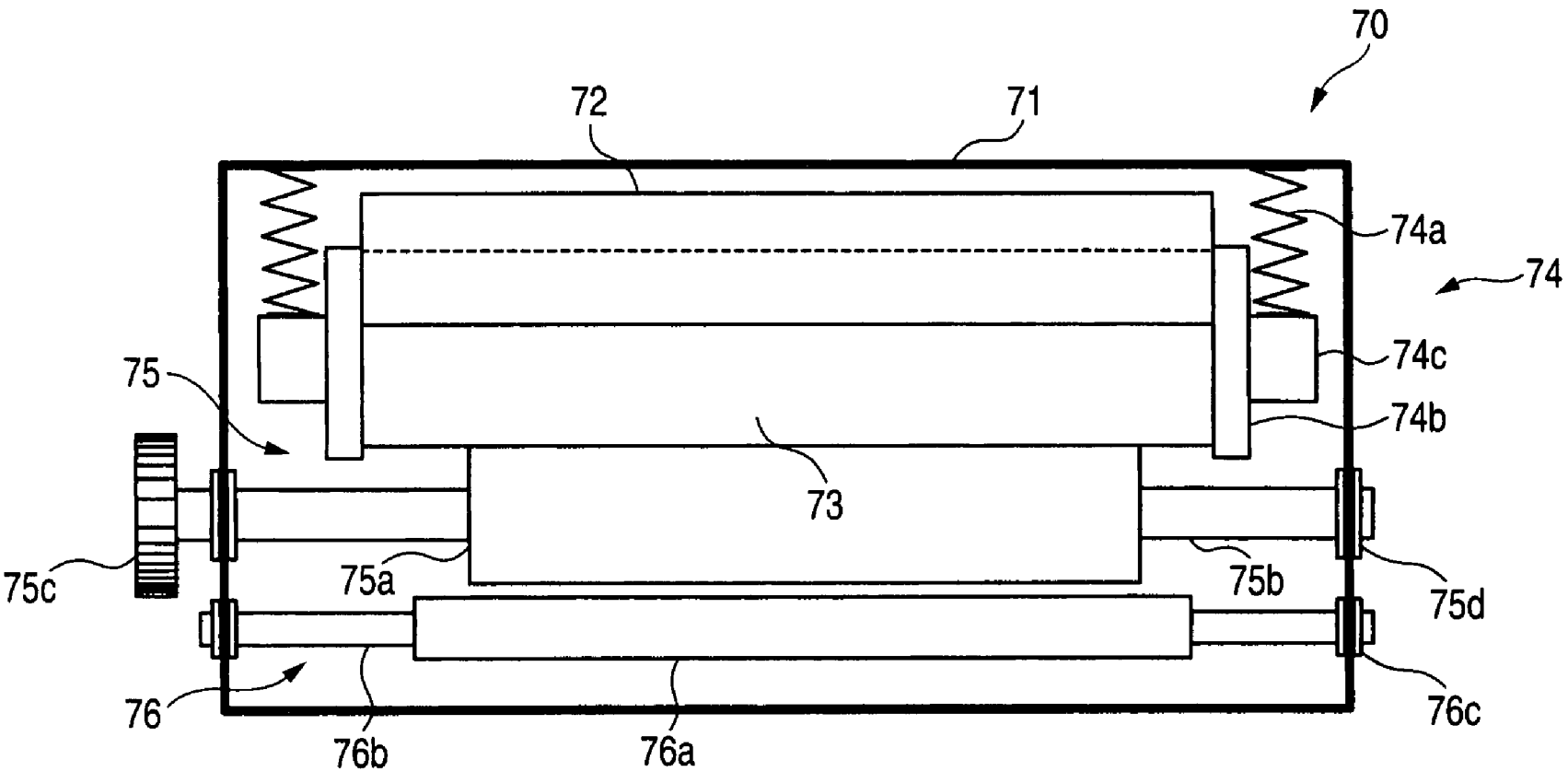
FIG. 7 is schematic configuration drawing to show a fixing device of a second exemplary embodiment of the invention.

FIG. 7 is schematic configuration drawing to show a fixing device 70 of a second exemplary embodiment of the invention. The fixing device 70 uses an electromagnetic induction heat belt shaped like a cylinder like the fixing device shown in FIG. 12 and is a device using the pressurization roll drive method and the electromagnetic induction heating method.

The fixing device 70 shown in FIG. 7 includes a fixing belt 73 as a belt member, a magnetic field generation section 72 placed in the proximity of the fixing belt 73 as a heating section for generating a magnetic field and heating the fixing belt 73, a pressurization roll 75 as a pressurization member for giving applied pressure to the fixing belt 73, and a cooling member 76 placed in the proximity of the pressurization roll 75 for cooling the pressurization roll 75. The fixing device 70 also includes support modules 74 for supporting a press force support member 77 (described later with reference to FIG. 9) placed in the fixing belt 73 and the like and a housing 71 for housing the magnetic field generation section 72, the fixing belt 73, etc.

The magnetic field generation section 72 as the heating section generates a magnetic field, thereby causing a heat generation layer 73*b* of the fixing belt 73 (described later with reference to FIG. 10) to generate heat (induction heating) for heating the fixing belt 73.

The fixing belt 73 is an endlessly formed member and is formed having roughly the same width (length) as that of the magnetic field generation section 72 along the longitudinal direction of the magnetic field generation section 72.

The support module 74 is provided on both sides of the fixing belt 73. Each support module 74 includes a coil spring 74*a* connected at one end to the upper inner wall of the housing 71 and a cylindrical or columnar retention part 74*c* connected to an opposite end of the coil spring 74*a* for receiving the urging force of the coil spring 74*a*. The support module 74 further includes a flange part 74*b* shaped roughly like a disk and connected to the retention part 74*c* for regulating a move of the fixing belt 73 in the lateral (width) direction thereof on both sides of the fixing belt 73.

The pressurization roll 75 includes a fixing part 75*a* against which the fixing belt 73 is pressed for fixing toner images supported on paper in the press part, cores 75*b* each provided at each of both ends of the fixing part 75*a* for supporting the fixing part 75*a*, and a gear part 75*c* provided at the end of one core 75*b*. A bearing member 75*d* for supporting the pressurization roll 75 for rotation with the housing 71 between the outer peripheral surfaces of both cores 75*b* and the housing 71. The pressurization roll 75 receives a drive force from a drive section (not shown) in the gear part 75*c* and rotates.

The cooling member 76 is placed roughly in parallel with the pressurization roll 75 and includes a main boy 76*a* placed with a predetermined spacing from the fixing part 75*a* of the pressurization roll 75 and support parts 76*b* each formed in a smaller diameter than the main boy 76*a* placed on each of both sides of the main boy 76*a*. Bearing members 76*c* are also provided each on the outer peripheral surface of each of both the support parts 76*b*, and the cooling member 76 is provided rotatably relative to the housing 71 through the bearing members 76*c*. The axial length of the main boy 76*a* in the cooling member 76 is set longer than the fixing part 75*a* of the pressurization roll 75. Further, the main boy 76*a* of the cooling member 76 is not limited if it can cool the pressurization roll 75; preferably it has good thermal conductivity. If the cooling member 76 has good thermal conductivity, the heat taken from the pressurization roll 75 in a non-small-size paper passage portion can be promptly moved to any other area in the longitudinal direction like a small-size paper passage portion and the cooling efficiency in the non-small-size paper passage portion can be enhanced. For example, a heat pipe or a solid aluminum roll can be named as the cooling member 76 having good thermal conductivity.

The periphery of the support module 74 will be discussed in more detail.

Figure 8:
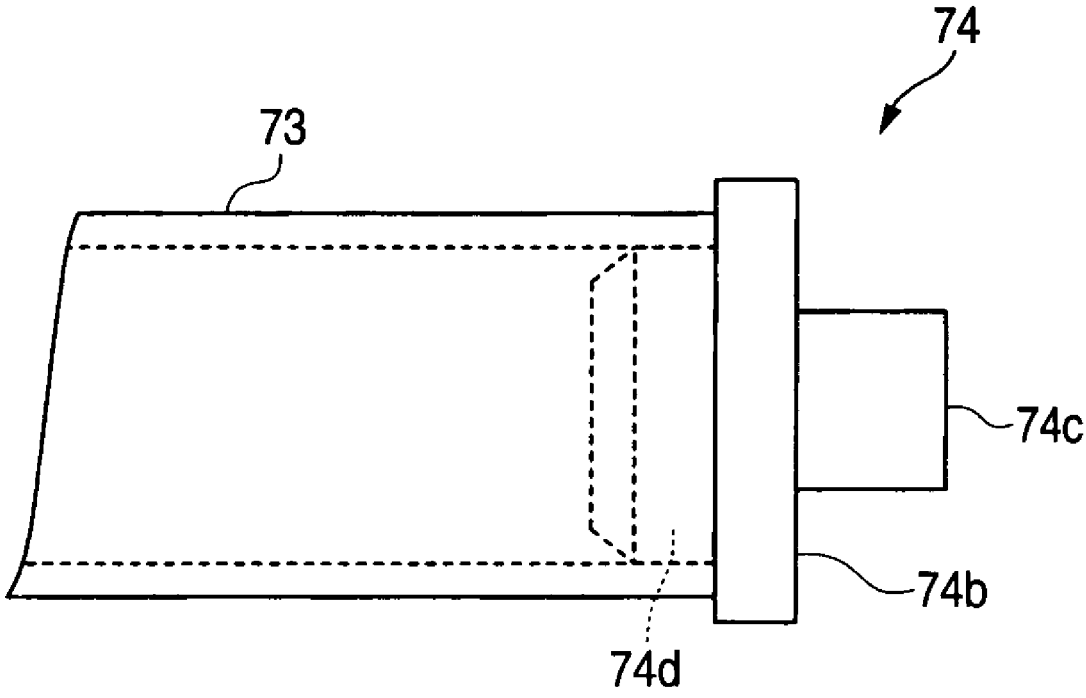
FIG. 8 is a configuration drawing to show the periphery of a support member in FIG. 7.

FIG. 8 is a configuration drawing to show the periphery of the support module 74 in FIG. 7.

The support module 74 further includes a cylindrical part 74*d*. The cylindrical part 74*d* is provided in the flange part 74*b* and is placed inside the fixing belt 73 formed like a cylinder.

Both ends of the fixing belt 73 are abutted against the flange part 74*b* of the support module 74, whereby meandering of the fixing belt 73 is regulated. The cylindrical part 74*d* has a function of keeping the shape of the belt member 73 roughly constant. Further, the cylindrical part 74*d* has an outer diameter slightly smaller than the inner diameter of the fixing belt 73 formed like a cylinder. Accordingly, it is made possible for the fixing belt 73 to turn in the surroundings of the cylindrical part 74*d*.

Further the fixing device 70 will be discussed from a different angle.

Figure 9:
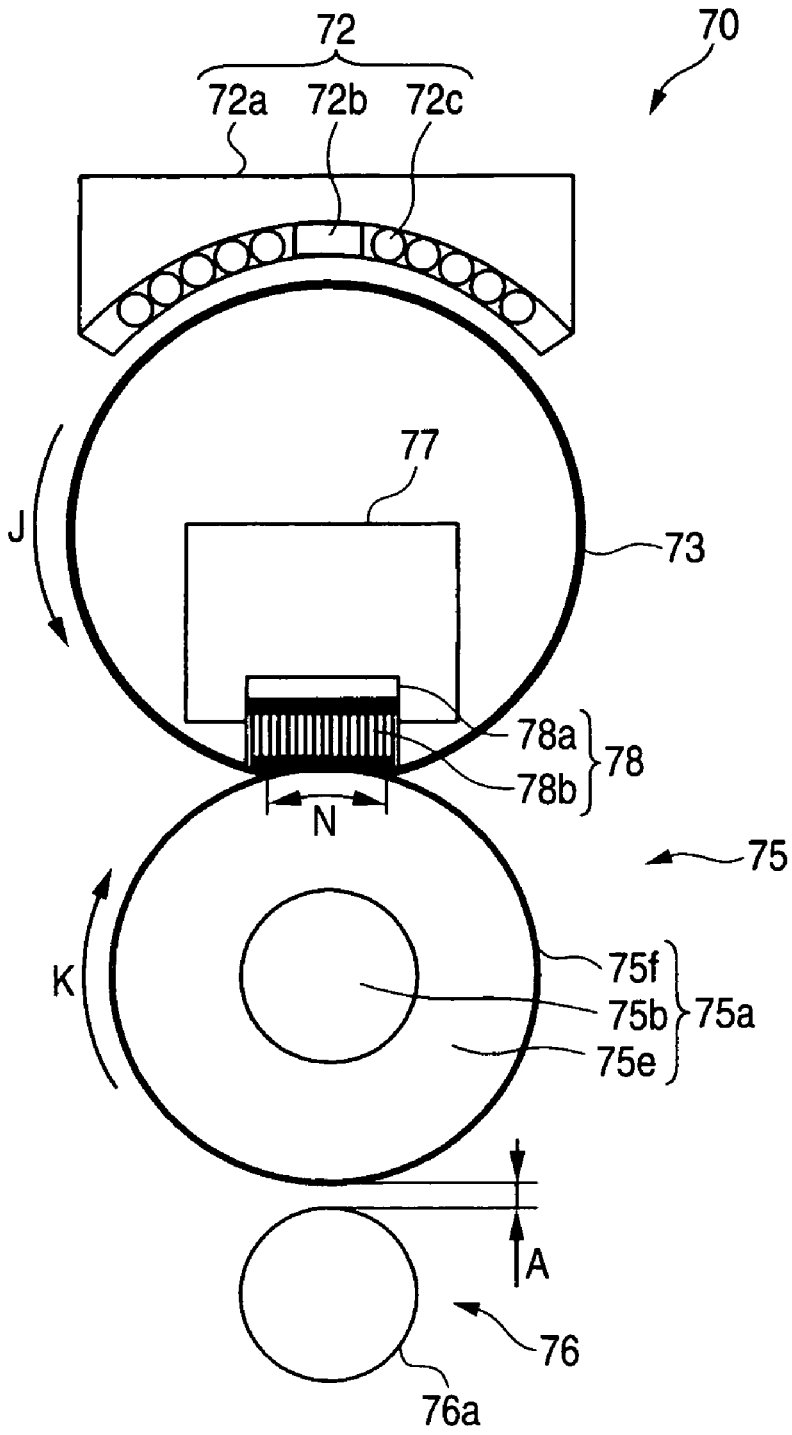
FIG. 9 is a schematic drawing to describe the cross-sectional configuration of the fixing device.

FIG. 9 is a schematic drawing to describe the cross-sectional configuration of the fixing device 70.

The fixing device 70 includes the magnetic field generation section 72, the fixing belt 73, the pressurization roll 75, and the cooling member 76 placed with a predetermined spacing A from the pressurization roll 75 in order from the top to the bottom in the figure. The fixing belt 73 contains the support member 77 and a pad member 78.

The magnetic field generation section 72 has a main part made up of an excitation coil retention member 72*a* having a curved surface following the outer peripheral surface shape of the fixing belt 73 along the width direction of the fixing belt 73 on the side of the fixing belt 73, an excitation coil 72*c* supported by the excitation coil retention member 72*a*, and a magnetic core 72*b* supported by the excitation coil retention member 72*a*.

The magnetic core 72*b* is a member of high magnetic permeability; preferably a material used with a core of a transformer such as ferrite or permalloy is used; more preferably ferrite with a small loss at 100 kHz or more is used.

To form the excitation coil 72*c*, a bundle of copper thin wires each with a covering of insulation is used as conductor wires (electric wires) making up the coil and is wound several times. In the exemplary embodiment, the excitation coil 72*c* is formed of 10 turns. As the material of the insulation covering of the thin wires, it is advisable to use covering having heat resistance considering thermal conduction of heat generation of the fixing belt 73. For example, it is advisable to use covering of polyamide, polyimide, etc.

The excitation coil 72*c* is formed so as to follow the curved surface of the fixing belt 73 of the heat generation layer. In the exemplary embodiment, the distance between the heat generation layer 73*b* of the fixing belt 73 (described later with reference to FIG. 10) and the excitation coil 72*c* is set to about 2 mm.

Further, an excitation circuit (not shown) to which a feeding section (not shown) is connected is connected to the excitation coil 72*c*. The excitation circuit can generate a high frequency ranging from 20 kHz to 500 kHz by a switching power supply. The excitation coil 72*c* generates an alternating magnetic flux using an altering current (high frequency current) supplied from the excitation circuit.

As the material of the excitation coil retention member 72*a*, preferably a material having an excellent insulating property and good heat resistance is used. For example, a phenol resin, a fluorocarbon resin, a polyimide resin, a polyamide resin, a polyamideimide resin, a PEEK resin, a PES resin, a PPS resin, a PFA resin, a PTFE resin, an FEP resin, an LCP resin, etc., can be selected.

The fixing belt 73 contains the pad member 78 and the press pressure support member 77.

The pad member 78 is a pad member as a press member; for example, it has silicone rubber 78*b* having elasticity deposited on a support member 78*a* having rigidity, made up of metal of SUS, iron, etc., a synthetic resin having high heat resistance, etc.

The support member 78*a* is placed in a state in which it is fixed to the press pressure support member 77 (described later) having rigidity capable of receiving the repulsive force from the pressurization roll 75. As the press pressure support member 77, preferably a material of an insulator is used so as not to undergo induction heating by the magnetic field generation section 72 and the press pressure support member 77 needs to have rigidity capable of suppressing to predetermined or less deflection upon reception of press pressure. As such a material, glass fiber mixed with polyethylene terephthalate (PET), polyphenylene sulfide (PPS), etc., can be named, for example.

Although not shown, the press pressure support member 77 is attached at both ends to the support module 74 shown in FIG. 7. The support module 74 is provided with the coil spring 74*a* for generating an urging force downward in the figure as described above. Thus, the downward urging force (in the direction of the pressurization roll 75) acts on the press pressure support member 77 and the pad member 78 attached to the press pressure support member 77. Consequently, the pad member 78 presses the pressurization roll 75 through the fixing belt 73 and forms a nip portion N of a predetermined width wherein paper is heated and pressurized between the fixing belt 73 and the pressurization roll 75.

The pressurization roll 75 is rotated clockwise (in the arrow K direction in the figure) by a drive source (not shown). The fixing belt 73 is placed so as to press the pressurization roll 75 in the nip portion N. Thus, when the pressurization roll 75 is rotated, a rotation force acts on the fixing belt 73 by a frictional force between the pressurization roll 75 and the fixing belt 73. Consequently, the fixing belt 73 rotates counterclockwise (in the arrow J direction in the figure). In the rotation, the fixing belt 73 enters a rotation state with the circumferential velocity almost corresponding to the rotation circumferential velocity of the pressurization roll 75 while the inner face of the fixing belt 73 comes in intimate contact with the lower face of the pad member 78 and slides. In this case, a lubricant such as heat resistant grease can also be interposed between the lower face of the pad member 78 and the inner face of the fixing belt 73 to decrease the mutual sliding frictional force between the lower face of the pad member 78 and the inner face of the fixing belt 73 in the nip portion N.

The fixing part 75*a* of the pressurization roll 75 includes a core 75*b* placed in the axial center, an elastic layer 75*e* having heat resistance, placed on the outer peripheral surface of the core 75*b*, and a mold release layer 75*f* placed on the outer peripheral surface of the elastic layer 75*e*. Consequently, the pressurization roll 75 is implemented as a soft roll. The elastic layer 75*e* is molded covering the core 75*b* like a roll concentrically in the surroundings of the core 75*b*. As the elastic layer 75*e*, a material of silicone rubber, fluoro rubber, etc., can be used. The mold release layer 75*f* can be formed of a material having a good mold release property, such as fluorocarbon resin. The mold release layer 75*f* facilitates removal of paper from the pressurization roll 75.

Next, the fixing belt 73 will be discussed.

Figure 10:
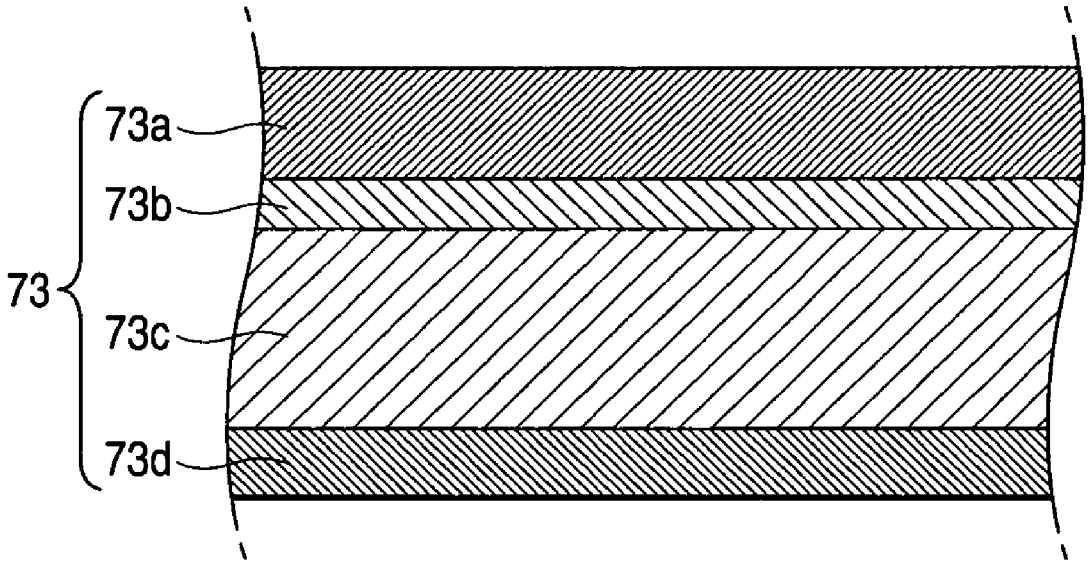
FIG. 10 is a schematic representation to show details of a fixing belt.

FIG. 10 is a schematic representation to show details of the fixing belt 73.

The fixing belt 73 in the exemplary embodiment is an electromagnetic induction heat belt shaped roughly like a cylinder. The fixing belt 73 has a composite structure of a substrate layer 73*a* made of a heat resistant resin as a base layer, the above-mentioned heat generation layer 73*b*, an elastic layer 73*c*, and a mold release layer 73*d* deposited on each other in order from the pad member 78 to the pressurization roll 75 shown in FIG. 9. To bond the layers, a primer layer (not shown) may be provided between the layers.

An alternating magnetic flux acts, so that an eddy current occurs and the heat generation layer 73*b* generates heat. The fixing belt 73 is heated by the generated heat. Finally, the heat is transmitted to the nip portion N (see FIG. 9) and paper supporting toner images, etc., positioned in the nip portion N is heated, whereby the toner images are heated and fixed.

As the substrate layer 73*a*, for example, a resin having high heat resistance preferably 10 to 100 μm in thickness, more preferably 50 to 100 μm (for example, 75 μm) in thickness. Specifically, for example, synthetic resin having high heat resistance such as polyester, polyethylene terephthalate, polyether sulfone, polyether ketone, polysulfone, polyimide, polyamideimide, polyamide, etc., can be named. In the exemplary embodiment, a polyimide resin 50 μm in thickness is used.

As the heat generation layer 73*b*, generally a metal layer of iron, cobalt, nickel, copper, chromium, etc., is formed about 1 to 50 μm in thickness. Preferably, the fixing belt 73 is formed to be flexible because it is often deformed in the nip portion N (see FIG. 9). Thus, preferably the heat generation layer 73*b* is made thin as much as possible. In the exemplary embodiment, as the heat generation layer 73*b*, copper having high electric conductivity is used and the substrate layer 73*a* made of polyimide resin is coated with about 10 μm of copper plating (extremely thin) to enhance the heat generation efficiency.

Preferably, the elastic layer 73*c* uses a material having good heat resistance and good thermal conductivity. For example, silicone rubber, fluoro rubber, fluoro silicone rubber, etc., can be named. To ensure the quality of a fixed image, the elastic layer 73*c* needs to have a predetermined thickness.

To print a color image, particularly for a photo image, a solid image is formed over a large area on paper. In this case, if the mold release layer 73*d* of the heating face cannot follow asperities on the paper or asperities on the toner layer, heating unevenness occurs because of the heat transfer amount difference. Specifically, gloss unevenness occurs in such a manner that the gloss value rises in the portion in which the heat transfer amount is large and the gloss value lowers in the portion in which the heat transfer amount is small.

Then, it is desirable that the thickness of the elastic layer 73*c* should be set in the range of 10 to 1000 μm. If the thickness of the elastic layer 73*c* is 10 μm or less, asperities on the paper or the toner layer cannot be followed and image gloss unevenness occurs. If the thickness of the elastic layer 73*c* is 1000 μm or more, the thermal resistance becomes large and it becomes hard to realize quick start. The more preferable thickness of the elastic layer 73*c* is 10 to 500 μm and the furthermore preferable thickness of the elastic layer 73*c* is 50 to 500 μm.

It is desirable that the hardness of the elastic layer 73*c* should be 60° (JIS-A: JIS-K A-type tester) or less. If the hardness is too high, asperities on paper or toner layer cannot be followed and there is a possibility that image gloss unevenness may occur. The more preferable hardness of the elastic layer 73*c* should be 45° or less.

Preferably, thermal conductivity λ of the elastic layer 73*c* is $6\times10^{-4}$ to $2\times10^{-3}$ [cal/cm·sec·deg.]. If the thermal conductivity λ is smaller than $6\times10^{-4}$ [cal/cm~sec~deg.], thermal resistance is large and the temperature rise on the surface layer of the fixing belt 73 (mold release layer 73*d*) is delayed. If the thermal conductivity λ is larger than $2\times10^{-3}$ [cal/cm·sec·deg.], the hardness becomes too high or compressive set worsens. More preferably, the thermal conductivity λ is $8\times10^{-4}$ to $1.5\times10^{-3}$ [cal/cm·sec·deg.].

As the mold release layer 73*d*, in addition to fluorocarbon resin of PFA, PTFE, FEP, etc., a material having good mold release characteristics and good heat resistance such as silicone rubber or fluoro rubber can be selected.

Preferably, the thickness of the mold release layer 73*d* is 20 to 100 μm. If the thickness of the mold release layer 73*d* is smaller than 20 μm, a portion where the mold release characteristics are poor occurs because of coat unevenness of coating film and durability is insufficient. If the thickness of the mold release layer 73*d* exceeds 100 μm, thermal conduction worsens. Particularly, if the mold release layer 73*d* is made of a resin-based material, when the thickness of the mold release layer 73*d* exceeds 100 μm, the hardness becomes too high and the effect of the elastic layer 73*c* is lost.

Next, the cooling member 76 will be discussed.

The cooling member 76 is placed with a spacing A between the main boy 76*a* of the cooling member 76 and the fixing part 75*a* of the pressurization roll 75 in a state in which the cooling member 76 is brought close to the pressurization roll 75 in non-contact with the pressurization roll 75. As shown in FIG. 7, the axis center of the cooling member 76 and the axis center of the pressurization roll 75 are roughly parallel and the cooling member 76 is placed along the axial direction of the pressurization roll 75.

The pressurization roll 75 receives the effect of heat generation of the fixing belt 73 described above and is heated and expands outward.

Figure 11A:
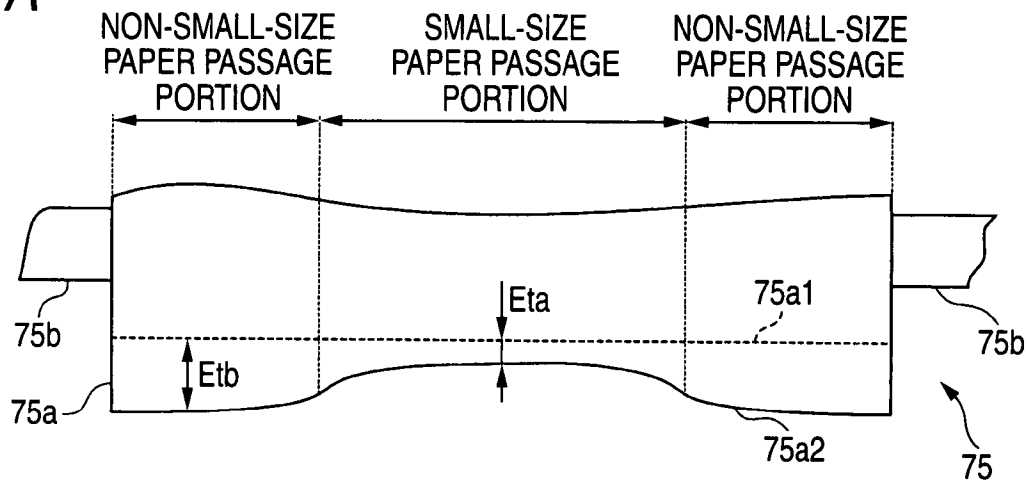
FIGS. 11A and 11B are schematic representations to show in detail the periphery of a pressurization roll when the pressurization roll terminally expands.
Figure 11B:
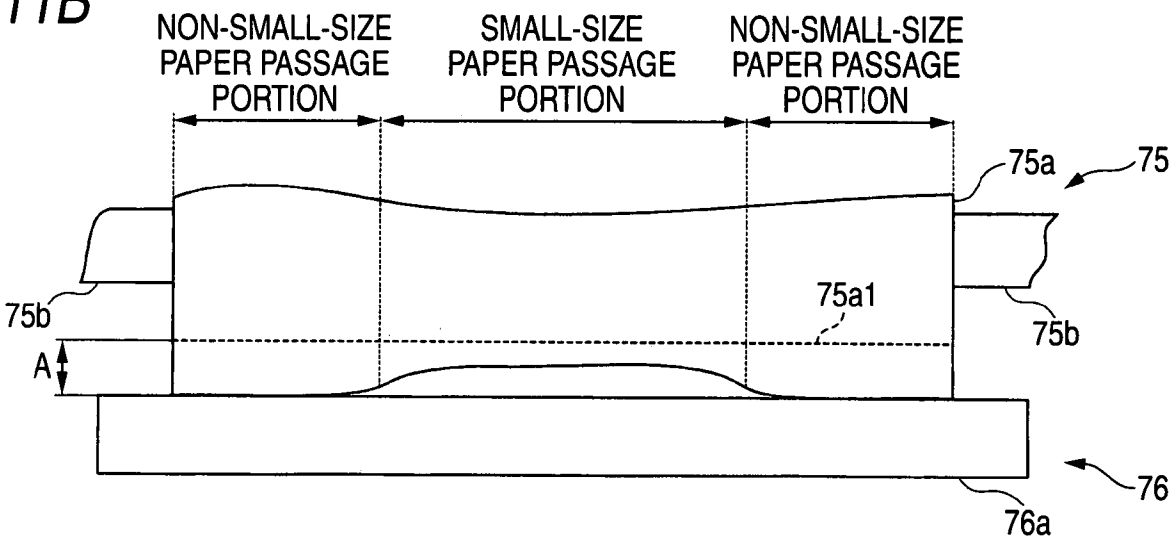

FIGS. 11A and 11B are schematic representations to show in detail the periphery of the pressurization roll 75 when the pressurization roll 75 terminally expands; FIG. 11A shows only thermal expansion of the pressurization roll 75 with the cooling member 76 excluded and FIG. 11B shows the pressurization roll 75 and the cooling member 76 when the pressurization roll 75 terminally expands.

As described in the first exemplary embodiment, the temperature and the thermal expansion amount in the axial direction of the pressurization roll 75 are not necessarily uniform and may vary from one place to another. For example, in a portion through which paper is passed, the paper takes heat and thus the temperature lowers and the expansion degree lessens. On the other hand, in a portion through which paper is not passed, paper does not take heat and thus the temperature does not much lower and the expansion degree increases.

The fixing device 70 in the exemplary embodiment is a center registration device wherein at the fixing time, paper passes through with the rough center in the axial direction of the pressurization roll 75 as the center. Thus, for example, if small-size paper having a narrower width than the maximum paper passage width is fixed, the temperature of the pressurization roll 75 in the portion corresponding to the small-size paper width lowers with the rough center of the pressurization roll 75 as the center.

FIG. 11A shows a state in which small-size paper is continuously passed through. As shown in the figure, the pressurization roll 75 receives the effect of heat of the fixing belt 73 and expands outward in the axial direction of the pressurization roll 75 as a whole. However, the paper takes heat in the small-size paper passage portion and thus thermal expansion amount Eta occurring in the direction of the cooling member 76 in the area is smaller than thermal expansion amount Etb occurring in the direction of the cooling member 76 in the non-small-size paper passage portion formed on both sides of the small-size paper passage portion. Consequently, the outer surface of the pressurization roll 75 becomes depressed in the rough center. The thermal expansion amounts Eta and Etb indicate the distance between an outer surface 75*a*1 of the pressurization roll 75 at room temperature and an outer surface 75*a*2 of the pressurization roll 75 after thermal expansion, as shown in the figure.

If temperature unevenness is thus involved in the pressurization roll 75, it is feared that a fixing failure may be caused to occur. If the pressurization roll 75 unevenly thermally expands, it is also feared that the pressurization roll 75 may be broken and that thermal deformation of the pressurization roll 75 may cause a fixing failure to occur. Further, if the temperature in the non-small-size paper passage portion rises, it may rise to the range in which the member will be degraded. Then, in the exemplary embodiment, the cooling member 76 is provided in the proximity of the pressurization roll 75 as in FIG. 11B, thereby suppressing occurrence of the problems.

The cooling member 76 is placed close to the pressurization roll 75 with a predetermined spacing A from the outer surface 75*a*1 of the pressurization roll 75 at room temperature (also see FIG. 9). The spacing A is set equal to or less than the thermal expansion amount Etb in the non-small-size paper passage portion when small-size paper is continuously passed through and is set larger than the thermal expansion amount Eta in the small-size paper passage portion. Consequently, the cooling member 76 comes in contact with the pressurization roll 75 in the non-small-size paper passage portion, but does not come in contact with the pressurization roll 75 in the small-size paper passage portion. According to the configuration, the pressurization roll 75 in the non-small-size paper passage portion is cooled, so that occurrence of breakage of the pressurization roll 75, member degradation, etc., can be suppressed. As the non-small-size paper passage portion is cooled, the temperature distribution in the axial direction of the pressurization roll 75 is uniformed and further the non-small-size paper passage portion shrinks and the difference between the outer diameter of the pressurization roll 75 in the small-size paper passage portion and the outer diameter of the pressurization roll 75 in the non-small-size paper passage portion lessens. Consequently, a fixing failure, etc., can also be suppressed.

In other words, attention is focused on the fact that a large temperature difference occurs between the small-size paper passage portion and the non-small-size paper passage portion in the fixing belt 73 and the pressurization roll 75 when small-size paper is continuously passed through. The positions of the pressurization roll 75 and the cooling member 76 are set so that the pressurization roll 75 comes in contact with the cooling member 76 first when the pressurization roll 75 thermally expands as the temperature in the non-small-size paper passage portion rises. That is, letting the distance between the surface of the pressurization roll 75 and the surface of the cooling member 76 at room temperature be A, the thermal expansion amount of the pressurization roll 75 in the small-size paper passage portion when small-size paper is continuously passed through be Eta, and the thermal expansion amount of the pressurization roll 75 in the non-small-size paper passage portion when small-size paper is continuously passed through be Etb, the following relation (1) holds among them:

$$0<\mathrm{Eta}<\mathrm{A}\leqq\mathrm{Etb} \quad (1)$$

A more detailed description is given according to the specific experiment again with reference to FIGS. 7 to 11.

To begin with, as the fixing belt 73, a fixing belt made up of polyimide 75 μm in thickness as the substrate layer 73*a*, copper 10 μm in thickness as the heat generation layer 73*b*, silicone rubber 200 μm in thickness as the elastic layer 73*c*, and PFA resin 30 μm in thickness as the mold release layer 73*d* is used.

As the core 75*b* of the pressurization roll 75, a hollow roll formed of aluminum and having an outer diameter of 18 mm is used. A silicone rubber sponge layer having a thickness of 5 mm, surface hardness of Ask-C60°, and a straight outer diameter distribution is formed as the elastic layer 75*e* on the core 75*b*. A PFA resin layer 30 μm in thickness is provided as the mold release layer 75*f* on the silicone rubber sponge layer.

Further, other conditions are as follows: The small-size paper passage portion in the fixing belt 73 is controlled at 170° C. The pressing load of the pad member 78 and the pressurization roll 75 is set to 30 kgf. Further, the liner speed of the fixing belt 73 is set to 140 mm/s. One excitation coil 72*c* is provided, thereby heating the full width of the fixing belt 73.

In the configuration described above, the maximum allowable temperature of the fixing belt 73 is about 230° C. from the heat resistance of silicone rubber. There is a temperature correlation between the fixing belt 73 and the pressurization roll 75 for coming in contact with the fixing belt 73 and if the temperature of the fixing belt 73 is 230° C., the temperature of the pressurization roll 75 becomes about 170° C. Thus, if the temperature of the pressurization roll 75 exceeds 170° C., it is feared that the temperature of the fixing belt 73 may exceed 230° C.

Therefore, to prevent the temperature of the fixing belt 73 from exceeding 230° C. of the maximum allowable temperature, the temperature of the pressurization roll 75 needs to be suppressed to 170° C. or less. More specifically, since the temperature in the non-small-size paper passage portion becomes higher than the temperature in the small-size paper passage portion as described above, the temperature of the pressurization roll 75 in the non-small-size paper passage portion needs to be suppressed to 170° C. or less. At least, when the temperature of the non-small-size paper passage portion of the pressurization roll 75 becomes close to 170° C., the cooling member 76 is brought into contact with the non-small-size paper passage portion of the pressurization roll 75 for cooling it, it is made possible to suppress the temperature of the fixing belt 73 to 230° C. or less.

On the other hand, the pressurization roll 75 having the configuration described above thermally expands about 100 μm in the radius at 110° C. and about 300 μm in the radius at 170° C. The temperature of the small-size paper passage portion in the pressurization roll 75 when small-size paper is continuously passed through is about 110° C. If the above-described relation (1) is applied, the spacing A between the surface of the pressurization roll 75 and the surface of the cooling member 76 in the above-described condition can be obtained as the following range:

$$0.1<A(\mathrm{mm})\leqq 0.3$$

Then, in the exemplary embodiment, small-size paper is continuously passed through with the spacing A set to 2 mm. Consequently, the temperature of the non-small-size paper passage portion of the pressurization roll 75 is able to be suppressed to 170° C. or less. Thus, the temperature of the non-small-size paper passage portion of the fixing belt 73 is able to be suppressed to 230° C. or less.

In the exemplary embodiment, one excitation coil is used as indicated in the experimental result described above. To use plural excitation coils, there are problems of an increase in the cost, complicated control, etc. Thus, it is desirable that one excitation coil should be used as in the exemplary embodiment. However, to use one excitation coil, the heat generation area of the fixing belt 73 using the excitation coil becomes the full area in the width direction of the fixing belt 73. Thus, it is feared that the temperature in the non-small-size paper passage portion may rise to the temperature at which the member will be degraded. To address this problem, it is also possible to use a technique of abutting a member having good thermal conductivity against the fixing member of the fixing belt 73, etc., at all times, thereby partially cooling the fixing member and smoothing the temperature in the width direction of the fixing member. In such a technique, however, as the member having good thermal conductivity is added, the heat capacity of the fixing member becomes large, thus prolonging the warm-up time; this is a problem. To address this problem, it is also possible to use a technique of providing an additional mechanism for bringing the member having good thermal conductivity toward and away from the associated member. However, the technique incurs complication of the apparatus, an increase in the cost, and upsizing of the apparatus; this is a problem.

On the other hand, in the exemplary embodiment, the pressurization roll 75 and the cooling member 76 are placed with the spacing A therebetween and do not come in contact with each other at room temperature as described above. The fixing device includes the cooling member 76 for starting to come in contact with the pressurization roll 75 as the pressurization roll 75 thermally expands. Thus, the heat capacity of the pressurization roll 75 does not become large, so that prolonging the warm-up time can be prevented. It is made possible to cool the pressurization roll 75 without providing any mechanism for bringing the cooling member 76 toward and away from the pressurization roll 75, so that complication of the apparatus, an increase in the cost, and upsizing of the apparatus can be prevented.

More particularly, letting the distance between the surface of the pressurization roll 75 and the surface of the cooling member 76 at room temperature be A, the thermal expansion amount of the pressurization roll 75 in the small-size paper passage portion when small-size paper is continuously passed through be Eta, and the thermal expansion amount of the pressurization roll 75 in the non-small-size paper passage portion when small-size paper is continuously passed through be Etb, if the relation $0<\mathrm{Eta}<A\leqq\mathrm{Etb}$ is satisfied, the temperature distribution when small-size paper is continuously passed through can be improved without prolonging the warm-up time. Since a complicated mechanism need not be installed, the cost does not increase and the apparatus can also be miniaturized.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed:

1. A fixing device for fixing a toner image onto a recording medium, the fixing device comprising:

a belt member rotatably provided;

a heating section that heats the belt member;

a pressurization member, placed so as to be pressed against the belt member, that forms a nip portion to allow the recording medium to pass through between the pressurization member and the belt member; and a uniforming section that is configured to heat or cool the pressurization member in order to uniform a temperature distribution of the pressurization member in a longitudinal direction of the pressurization member, the uniforming section including:

a contact member that comes in contact with the pressurization member and that is formed in a roll shape;

a cooling section that cools the contact member; and a heating section that heats the contact member.

2. The fixing device as claimed in claim 1, wherein the contact member includes:

a first face contacting with the pressurization member; and a second face not contacting with the pressurization member, the pressurization member includes:

a third face corresponding to the first face; and a fourth face corresponding to the second face, the third face is a face through which a recording medium having a narrower width than a maximum paper passage width is to pass.

3. The fixing device as claimed in claim 2, wherein a first outer diameter in the first face is formed larger than a second outer diameter in the second face.

4. The fixing device as claimed in claim 1, wherein the contact member includes:

a first face contacting with the pressurization member; and a second face not contacting with the pressurization member, the pressurization member includes:

a third face corresponding to the first face; and a fourth face corresponding to the second face, the fourth face is a face through which a recording medium having a narrower width than the maximum paper passage width is to pass.

5. The fixing device as claimed in claim 4, wherein a first outer diameter in the first face is formed larger than a second outer diameter in the second face.

6. The fixing device as claimed in claim 1, further comprising:

a switch section that switches the uniforming section between a heating state heating the pressurization member by the heating section and a cooling state cooling the pressurization member by the cooling section in response to a size of the recording medium.

7. The fixing device as claimed in claim 1, further comprising a move section that brings the contact member in contact with the pressurization member away from the pressurization member.

8. The fixing device as claimed in claim 1, wherein the pressurization member comprises an elastic layer for becoming deformed in the nip portion.

9. An image forming apparatus comprising:

an image forming device that forms a toner image on an image carrier;

a transfer device that transfers the toner image onto a recording medium; and a fixing device that fixes the toner image onto the recording medium, the fixing device comprising:

a belt member rotatably provided; a heating section that heats the belt member;

a pressurization member, placed so as to be pressed against the belt member, that forms a nip portion to allow the recording medium to pass through between the pressurization member and the belt member; and a uniforming section that is configured to heat or cool the pressurization member in order to uniform a temperature distribution of the pressurization member in a longitudinal direction of the pressurization member, the uniforming section including:

a contact member that comes in contact with the pressurization member and that is formed in a roll shape;

a cooling section that cools the contact member; and a heating section that heats the contact member.

* * * * *